US009664441B2

(12) United States Patent
Brodt

(10) Patent No.: US 9,664,441 B2
(45) Date of Patent: May 30, 2017

(54) METHODS AND SYSTEMS FOR UNDERWATER GAS PRESSURIZATION AND LIQUEFACTION

(71) Applicant: S.G.B.D. TECHNOLOGIES LTD., Haifa (IL)

(72) Inventor: Alexander Brodt, Beer Sheva (IL)

(73) Assignee: S.G.B.D. TECHNOLOGIES LTD., Haifa (IL)

( * ) Notice: Subject to any disclaimer, the term of this patent is extended or adjusted under 35 U.S.C. 154(b) by 376 days.

(21) Appl. No.: 13/950,317

(22) Filed: Jul. 25, 2013

(65) Prior Publication Data

US 2015/0020541 A1 Jan. 22, 2015

(30) Foreign Application Priority Data

Jul. 18, 2013 (IL) ..... 227549

(51) Int. Cl.
*F02M 9/127* (2006.01)
*F25J 1/00* (2006.01)
(Continued)

(52) U.S. Cl.
CPC ..... *F25J 1/0022* (2013.01); *C10L 3/10* (2013.01); *F25J 1/0052* (2013.01); *F25J 1/0085* (2013.01);
(Continued)

(58) Field of Classification Search
CPC ..... F04F 1/00; F04F 1/02; F04F 1/06; F04F 1/08; F04F 1/14; F04F 3/00;
(Continued)

(56) References Cited

U.S. PATENT DOCUMENTS 1,157,993 A 10/1915 Mcelroy et al.
2,928,249 A 3/1960 Miles
(Continued)

FOREIGN PATENT DOCUMENTS

RU 2109930 12/2002
SU 486772 10/1975
(Continued)

OTHER PUBLICATIONS

Office Action for Israeli Application No. 227549 dated Sep. 29, 2014.
(Continued)

*Primary Examiner* — Frantz Jules
*Assistant Examiner* — Webeshet Mengesha
(74) *Attorney, Agent, or Firm* — Pearl Cohen Zedek Latzer Baratz LLP

(57) ABSTRACT

Underwater gas pressurization units and liquefaction systems, as well as pressurization and liquefaction methods are provided. Gas is compressed hydraulically by a rising pressurization liquid that is separated from the gas by a water immiscible liquid layer on top of an aqueous salt solution. Tall vessels are used to reach a high compression ratio that lowers the liquefaction temperature. The pressurizing liquid is delivered gravitationally, after gasification, transport to smaller water depths and condensation. Cooling units are used to liquefy the compressed gas. A cascade of compression and cooling units may be used with sequentially higher liquefaction temperatures, which allow eventual cooling by sea water. The pressurizing liquid, dimensions of the vessels, the delivery unit, the coolants and the implementation of the cooling units are selected according to the sea location, to enable natural gas liquefaction in proximity to the gas source.

13 Claims, 8 Drawing Sheets

(51) Int. Cl.

| | |
|---|---|
| ***F25J 1/02*** | (2006.01) |
| ***C10L 3/10*** | (2006.01) |
| *B01F 15/00* | (2006.01) |
| *F24F 6/12* | (2006.01) |
| *B01F 3/04* | (2006.01) |
| *B05B 17/06* | (2006.01) |

(52) U.S. Cl.
CPC ..... *F25J 1/0204* (2013.01); *F25J 1/0257* (2013.01); *F25J 1/0268* (2013.01); *F25J 1/0278* (2013.01); *F25J 1/0281* (2013.01); *B01F 3/04517* (2013.01); *B01F 15/005* (2013.01); *B01F 15/00525* (2013.01); *B05B 17/0615* (2013.01); *F24F 6/12* (2013.01); *F25J 2230/22* (2013.01); *F25J 2230/30* (2013.01); *F25J 2235/04* (2013.01); *F25J 2270/12* (2013.01); *F25J 2270/60* (2013.01)

(58) Field of Classification Search
CPC .... F04B 9/0005; F04B 39/0011; F04B 47/00; F25J 1/0022; F25J 1/0052; F25J 1/0085; F25J 1/0087; F25J 2210/60; F25J 2235/04; F25J 2270/12; F25J 2290/72
USPC ..... 417/99, 101
See application file for complete search history.

(56) References Cited

U.S. PATENT DOCUMENTS

| | | | | |
|---|---|---|---|---|
| 2,942,424 | A * | 6/1960 | Koble | B65G 5/00 405/59 |
| 3,605,414 | A | 9/1971 | Westmoreland, Jr. | |
| 3,727,418 | A * | 4/1973 | Glazier | F17C 3/005 114/257 |
| 4,209,271 | A * | 6/1980 | McCabe | F17B 1/00 114/256 |
| 4,402,632 | A | 9/1983 | Cook | |
| 6,494,251 | B2 | 12/2002 | Kelley | |
| 8,381,544 | B2 | 2/2013 | Coyle | |
| 2004/0159437 | A1* | 8/2004 | Choi | E21B 43/01 166/335 |
| 2006/0000615 | A1* | 1/2006 | Choi | B63B 27/24 166/352 |
| 2008/0041291 | A1* | 2/2008 | Horton | B65D 88/78 114/257 |
| 2009/0010717 | A1 | 1/2009 | Horton et al. | |
| 2012/0053562 | A1* | 3/2012 | Haase | A61M 5/14216 604/506 |
| 2012/0285656 | A1* | 11/2012 | Moore | F25J 1/0022 165/45 |

FOREIGN PATENT DOCUMENTS

| | | |
|---|---|---|
| WO | WO 2010/049821 | 5/2010 |
| WO | WO-2012/101478 | 8/2012 |

OTHER PUBLICATIONS

M.P. Malkov, I.B. Danilov, A.G. Zeldovich, A.B. Fradkov "Handbook on Physico-Technical Foundations of Deep Cooling", Ed. Prof. M.P. Malkov, Moscow-Leningrad: Gosenergoizdat, 1963, 416 pp.

V.G. Fastovsky, Yu.V. Petrovsky, A.E. Rovinsky "Cryogenic Technology", Ed. V.G. Fastovsky, 2nd Ed., Moscow: Energia, 1974, 496 pp.

PC Search Report for International Application No. PCT/IL2014/050612 dated Oct. 26, 2014.

Supplementary Partial European Search Report of European Patent Application EP 14826557 dated Feb. 2, 2017.

* cited by examiner

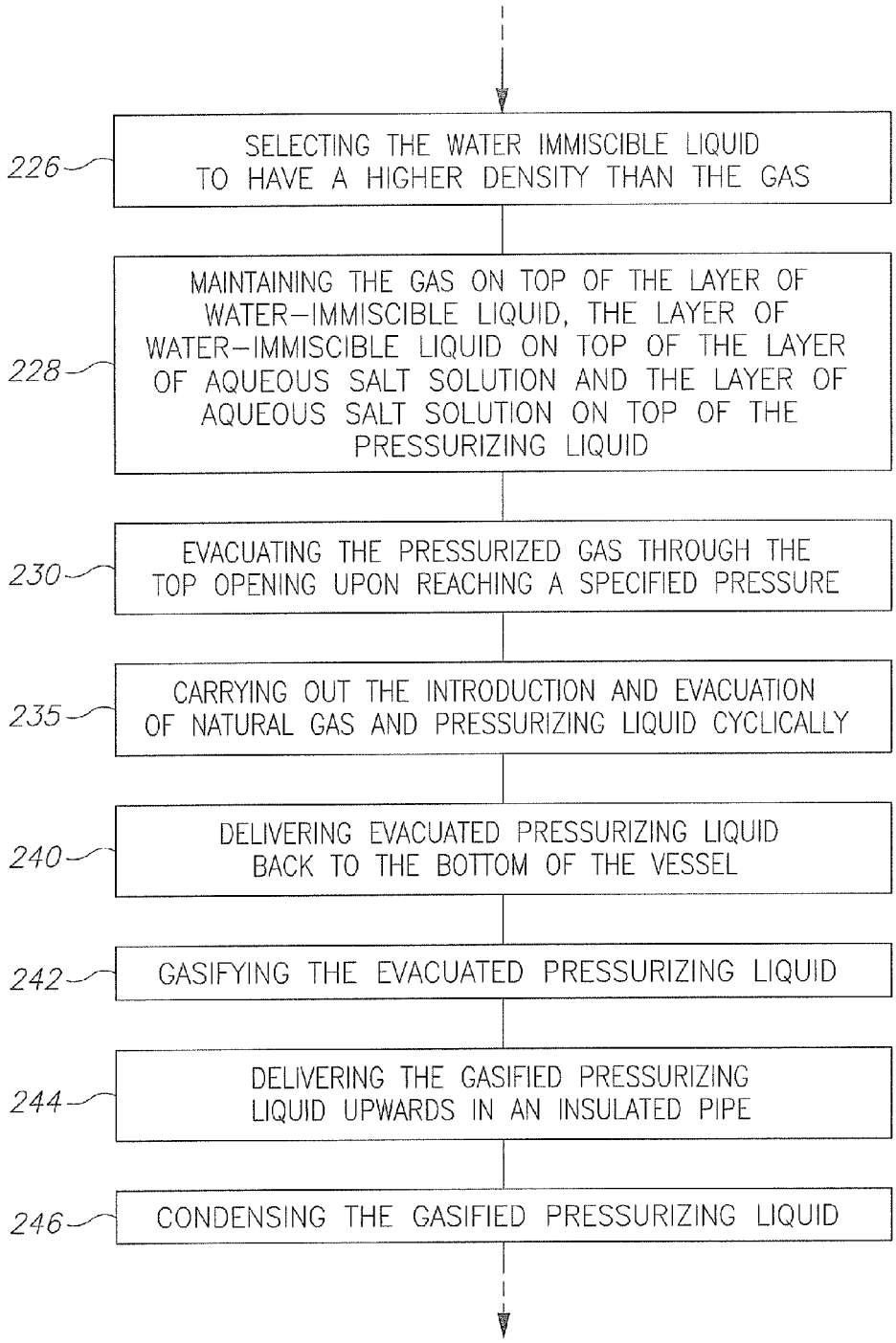
Figure 5 (cont. 1)

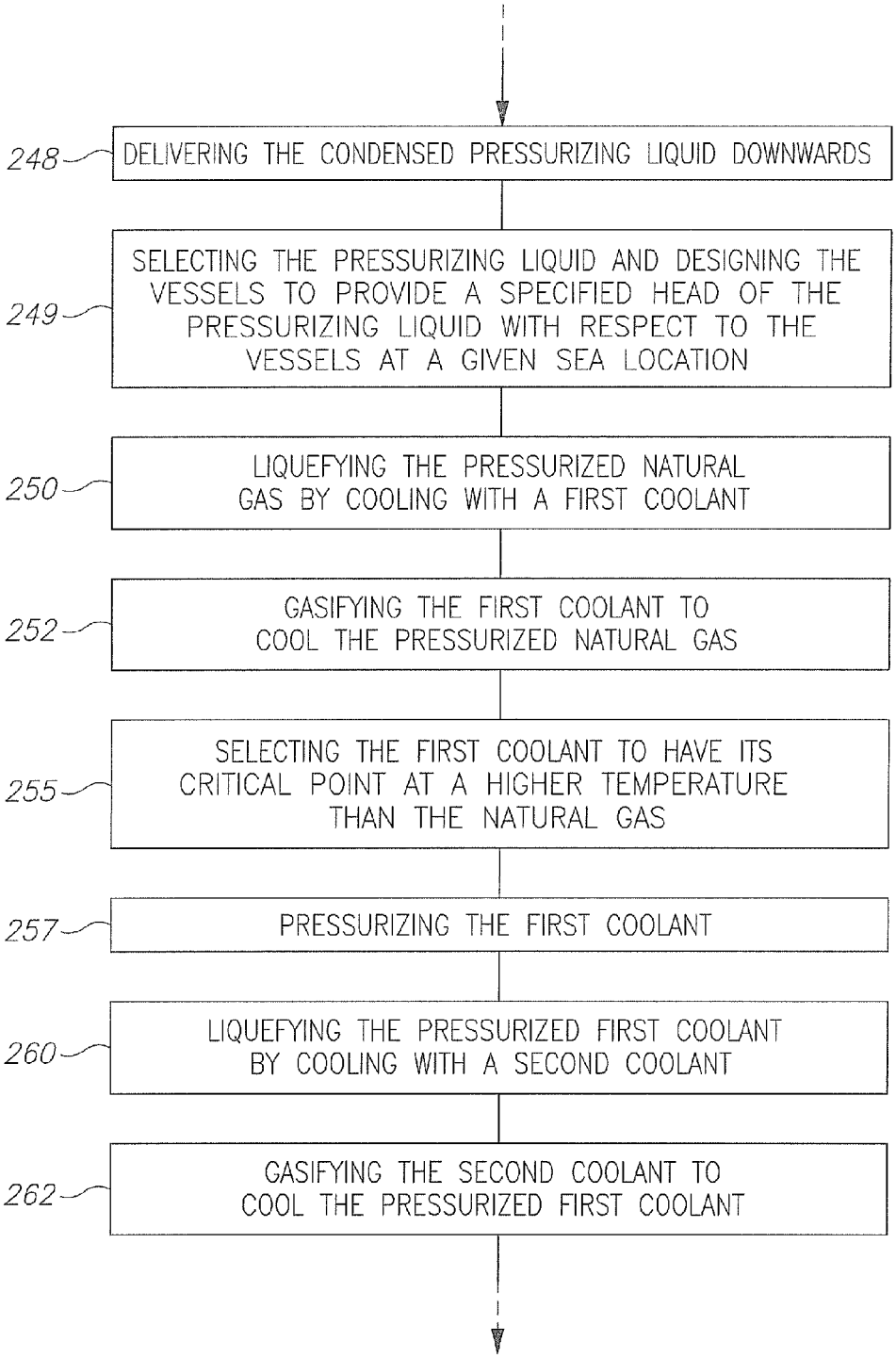
Figure 5 (cont. 2)

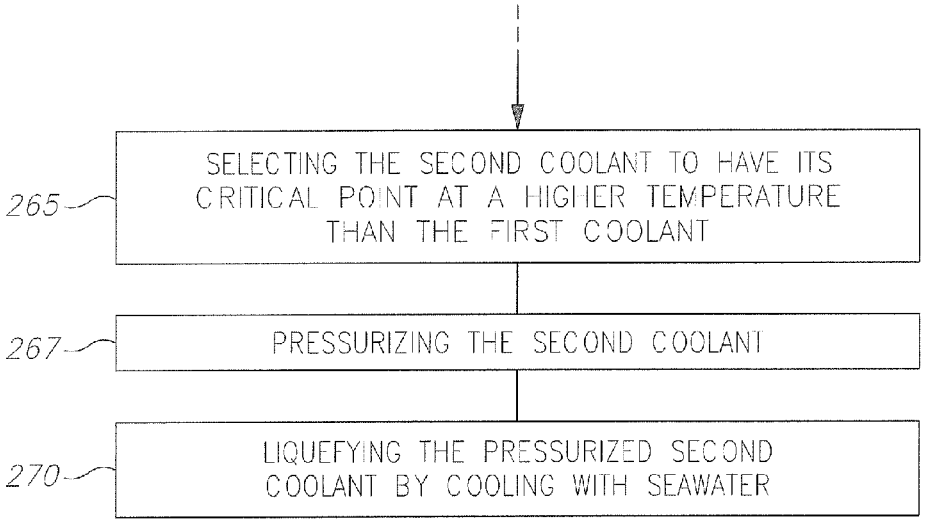
Figure 5 (cont. 3)

METHODS AND SYSTEMS FOR UNDERWATER GAS PRESSURIZATION AND LIQUEFACTION

CROSS REFERENCE TO RELATED APPLICATIONS

This application claims the benefit of Israeli Patent Application No. 227549 filed on Jul. 18, 2013 which is incorporated herein by reference in its entirety.

BACKGROUND OF THE INVENTION

1. Technical Field

The present invention relates to the field of thermodynamics, and more particularly, to gas pressurization and liquefaction 2. Discussion of Related Art Natural gas liquefaction poses significant challenges regarding its energy consumption and delivery of the natural gas to the liquefaction plant. Existing technologies use energy very extensively and require long pipework to deliver natural gas that is produced from sea sources.

SUMMARY OF THE INVENTION

One aspect of the present invention provides an underwater gas pressurization unit comprising: at least one vertical vessel arranged to receive gas through a top of the vessel and a pressurizing liquid through a bottom of the vertical vessel, and further comprising a layer of water-immiscible liquid upon a layer of aqueous salt solution, wherein a density of the pressurizing liquid is higher than a density of aqueous salt solution, which is in turn higher than a density of the water-immiscible liquid, to maintain the layer of aqueous salt solution on top of the pressurizing liquid and to maintain the layer of water-immiscible liquid on top of the layer of aqueous salt solution, and a valve system arranged to pressurize the gas by introducing the pressurizing liquid into the vessel, evacuate the pressurized gas through the top of the vertical vessel upon reaching a specified pressure and introduce gas into the vessel by evacuating the pressurizing liquid through the bottom of the vertical vessel.

Another aspect of the present invention provides an underwater natural gas liquefaction system comprising at least two underwater gas pressurization units, one arranged to compress natural gas and another arranged to compress a coolant that is used to cool the compressed natural gas.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

DETAILED DESCRIPTION OF THE INVENTION

Figure 1:
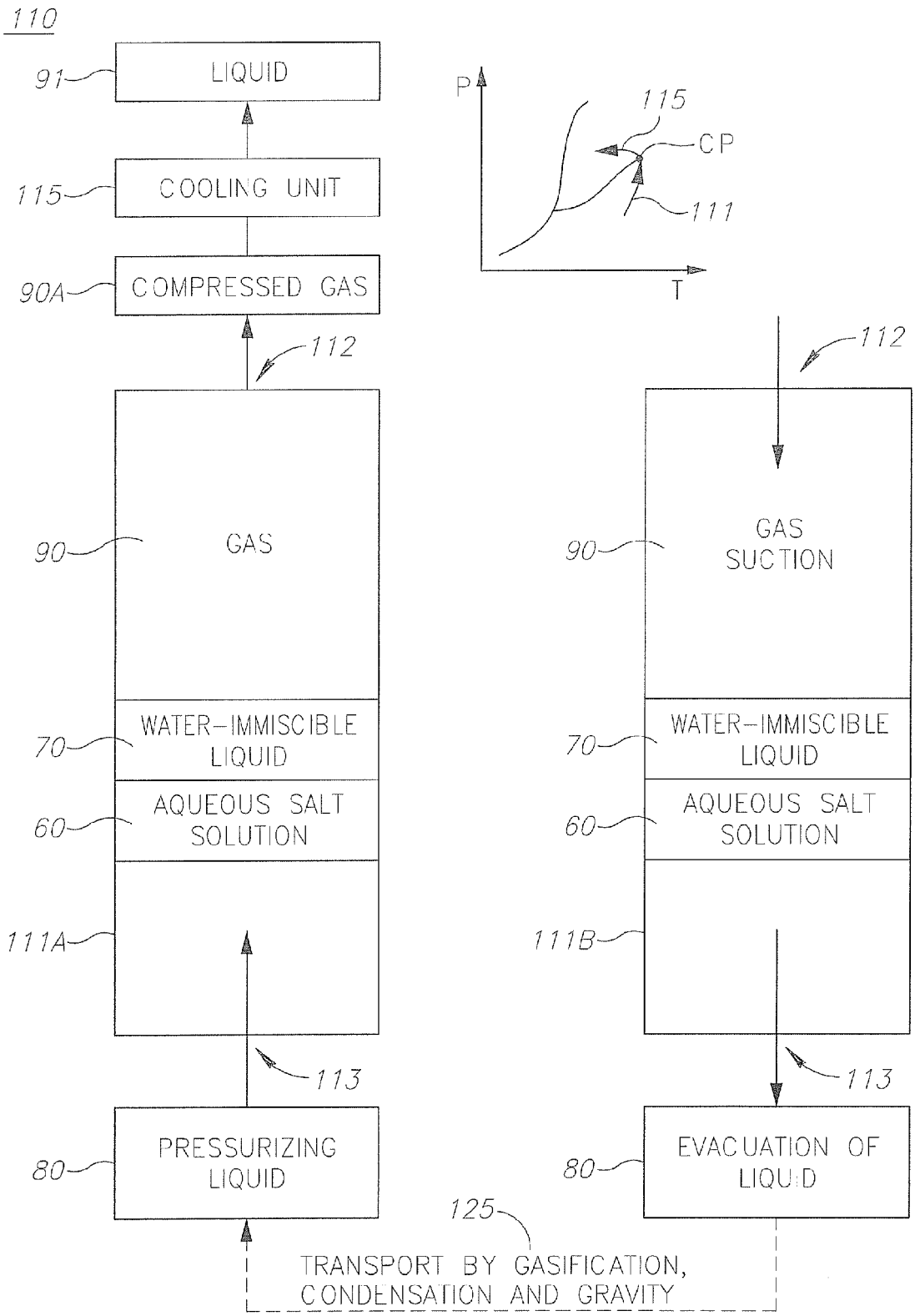
FIG. 1 is a high level schematic block diagram of an underwater gas pressurization unit, according to some embodiments of the invention.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before at least one embodiment of the invention is explained in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

In certain embodiments, underwater gas pressurization units and liquefaction systems, as well as pressurization and liquefaction methods are provided herein. Gas is compressed hydraulically by a rising pressurization liquid that is separated from the gas by a water immiscible liquid layer on top of a aqueous salt solution. Tall vessels are used to reach a high compression ratio that lowers the liquefaction temperature. The pressurizing liquid is delivered gravitationally, after gasification, transport to smaller water depths and condensation. Cooling units are used to liquefy the compressed gas. A cascade of compression and cooling units may be used with sequentially higher liquefaction temperatures, which allow eventual cooling by sea water. The pressurizing liquid, dimensions of the vessels, the delivery unit, the coolants and the implementation of the cooling units are selected according to the sea location, to enable natural gas liquefaction in proximity to the gas source.

Figure 2:
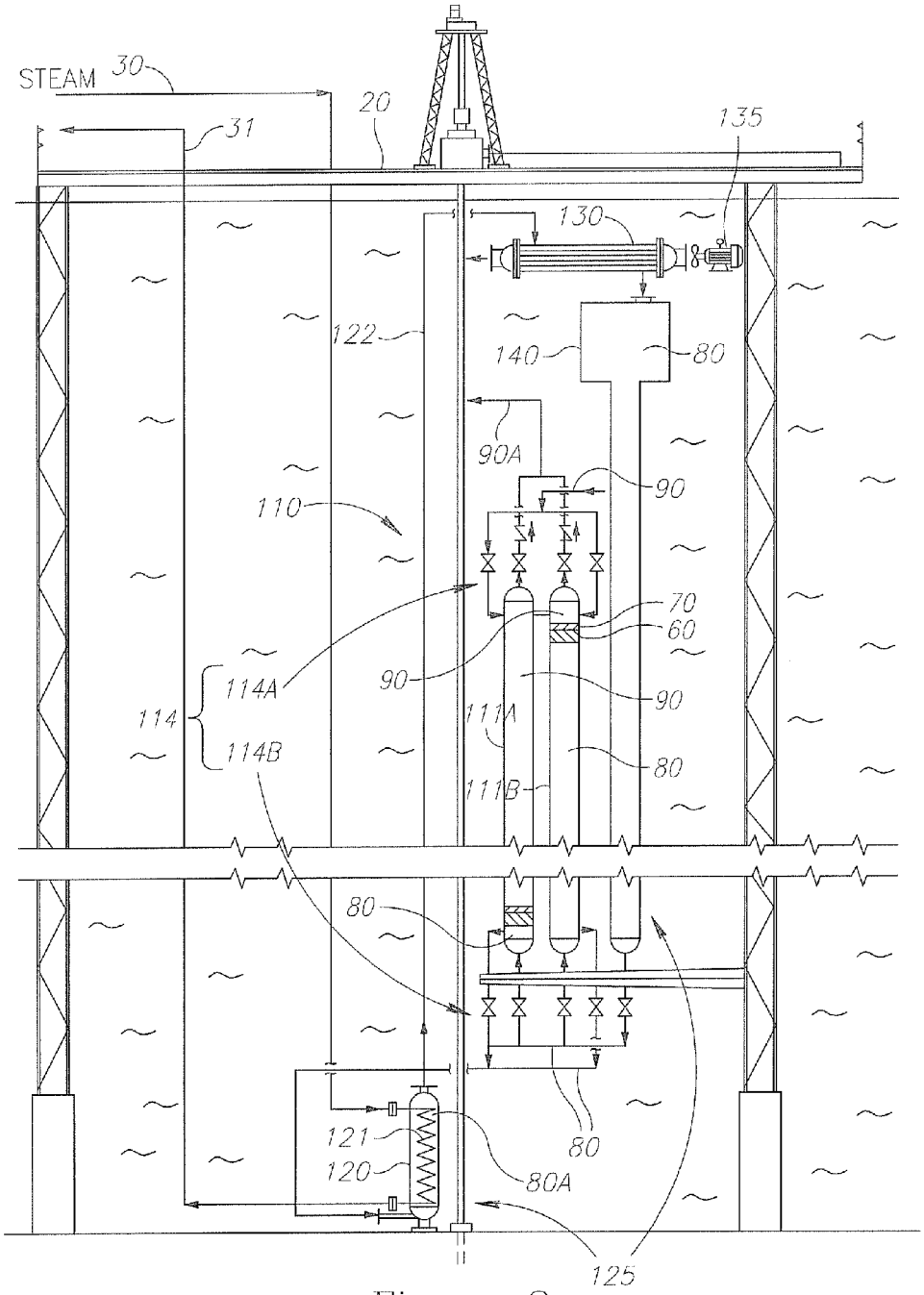
FIG. 2 is a high level schematic illustration of an underwater gas pressurization unit, according to some embodiments of the invention.

FIG. 1 is a high level schematic block diagram of an underwater gas pressurization unit 110, according to some embodiments of the invention. FIG. 2 is a high level schematic illustration of underwater gas pressurization unit 110, according to some embodiments of the invention. The thermodynamical processes used in the invention are shown schematically in FIG. 1 as pressurization 111 beyond the critical point and cooling the pressurized gas to liquefy 115 it.

Underwater gas pressurization unit 110 comprises at least one vertical vessel 111, illustrated in FIG. 1 in two operation states, denoted 111A for gas pressurization and 111B for gas suction, as explained below. Vertical vessel 111 is arranged to receive gas 90 through a top 112 of the vertical vessel, e.g., through a top opening, and a pressurizing liquid 80 through a bottom 113 of the vertical vessel, e.g., through a bottom opening.

Underwater gas pressurization unit 110 comprises a valve system 114 having a top subsystem 114A in fluid communication with top 112 of vessel 111 and a bottom sub system 114 in fluid communication with bottom opening 113. Subsystems 114A, 114 are arranged to control and regulate introduction and evacuation of gas 90 and liquid 80, respectively. Valve system 114 is arranged to pressurize gas 90 by introducing pressurizing liquid 80 into vessel 111, evacuate pressurized gas 90A through top opening 112 upon reaching a specified pressure and introduce gas 90 into vessel 111 by evacuating pressurizing liquid 80 through bottom 113 of vessel 111.

Vertical vessel 111 further comprises a layer of water-immiscible liquid 70 upon a layer of aqueous salt solution 60. The layers are arranged to separate pressurizing liquid 80 from gas 90 during the pressurizing and the suction of gas 90. Liquids 60, 70 are selected such that the density of pressurizing liquid 80 is higher than the density of aqueous salt solution 60, which is in turn higher than the density of water-immiscible liquid 70. Such selection of the densities (at working temperatures and pressures) is arranged to maintain layer of aqueous salt solution 60 on top of pressurizing liquid 80 and to maintain layer of water-immiscible liquid 70 on top of the layer of aqueous salt solution 60.

In certain embodiments, gas 90 goes through a preliminary purification of the initial raw material to remove harmful impurities. Then, gas goes through compression (at 111) and condensation (at 115) at the expense of its cooling by external coldness-transfer medium (cooling units 115, see below) refrigerated in the loop of its circulation of the previous stage of the refrigerating cascade, the gaseous phase in each stage of such refrigerating cascade is compressed in vertical vessels 111 arranged in sea water.

For this purpose, after filling vessel 111 with gaseous medium 90, a volatile and water-immiscible heavy non-aqueous liquid 80 is fed from a higher level into the lower part of each vessel 111, under a layer of water-salt medium 60, whose density is smaller than that of non-aqueous liquid 80, and which is screened e.g., by liquid hydrocarbon 70, having a density which is smaller than that of water-salt medium 60.

After pressing out compressed gas 90A by a rising column of heavy liquid 80, the suction of the next portion of gaseous medium 90 is realized by evacuating the main part of heavy non-aqueous liquid 80 out of vertical vessel 111.

The return of volatile heavy non-aqueous liquid 80 from vertical vessels 111 to the upper level is realized by its regasification in gasifier 120 (The term gasifier is used in the present disclosure in its physical meaning, i.e., it is a device that turns liquid to gas) at underwater conditions at the expense of heat exchange (e.g., coil 121) with the external heat-transfer medium (e.g., steam 30), with a subsequent discharge of the forming non-aqueous vapors 80A to the uppermost height mark for condensation in condenser 130 via insulated pipe 122. After that, non-aqueous heavy liquid 80, after condensing at the uppermost level, is fed by gravity again (in container 140) to the base of each vertical vessel 111, under the layer of water-salt medium 60 screened by liquid hydrocarbon 70.

In certain embodiments, pressurizing liquid 80 may comprise e.g., various incombustible and fire- and explosion-proof organic substances with a specified set of thermodynamic, rheological and hygiene and sanitary properties can be used as the volatile and water-immiscible heavy non-aqueous liquid. They are, e.g., completely (or partially) halogenated hydrocarbons of the alkane homologous series, such as perfluorocyclopentane, trifluorobromoethane, hexafluorochlorobromopropane, perfluoropentane, dibromofluoromethane or difluorodibromomethane or their mixtures.

In certain embodiments, aqueous salt solution 60 may comprise various solutions of mineral and organic salts in fresh (or sea) water with the density smaller than that of non-aqueous medium, such as solutions of calcium or magnesium nitrates, potassium, zinc and calcium bromides, potassium carbonates, formiates and acetates, various halides of other alkali metals, as well as compositions prepared on the basis of fresh (or sea) water, which contain, side by side with mineral salts, ethylene glycol, glycerin and other multi-component water-salt systems characterized not only by a lower specific weight in comparison with halogenated hydrocarbons, but also by a sufficiently low freezing temperature, can be used as water-salt media covering the column of the volatile heavy liquid.

In certain embodiments, water-immiscible liquid 70 may comprise various water-immiscible aliphatic or aromatic organic compounds having a low freezing temperature and the density smaller than that of mineral (organic) salts solutions 60, for example, hexane or toluene, can be used as liquid hydrocarbon screening the water-salt medium covering the column of the volatile liquid.

Pressurized gas 90A may be liquefied by a cooling unit 115, as explained in detail below.

The absence of any mechanical devices with electric drives for compressing gaseous media in the cascade method of methane liquefaction in each stage of such a cascade, and their compression in underwater vertical vessels at the expense of pressing the gaseous phase out of such cylinders by feeding non-aqueous heavy liquids 80 with a specified set of physical and other properties under the layer of water-salt medium 60, allows not only a drastic decrease in the cyclicity of the operation of such piston compressors that do not contain any moving mechanical parts, but also practically completely get without electric energy consumption for the realization of such a process.

Besides, underwater placement of high-pressure vessels 111 allows a considerable decrease in their materials output ratio (external hydrostatic pressure of sea-water compensates the internal pressure, which makes it possible to make such equipment with thinner walls).

The absence of high-speed mechanical compressor equipment with powerful electric drives not only reduces the price of the instrumental design of the process of the invention, but also significantly increases the safety of operation of such sea-bottom gas field.

Advantageously, all distinguishing features of the present invention are organically interconnected, and their mentioned combination allows the achievement of the object of the invention. The invention is however not to be understood as being limited by the details of the implementation that is exemplified below.

Embodiments of the invention, illustrated e.g., in FIGS. 1 and 2, comprise an underwater gas pressurization unit 110 comprising at least one vertical vessel 111 arranged to receive gas 90 through a top 112 of vessel 111 and a pressurizing liquid 80 through a bottom 113 of vessel 111, and further comprising a layer of water-immiscible liquid 70 upon a layer of aqueous salt solution 60. A density of pressurizing liquid 80 is higher than a density of aqueous salt solution 60, which is in turn higher than a density of water-immiscible liquid 70, to maintain the layer of aqueous salt solution 60 on top of pressurizing liquid 80 and to maintain the layer of water-immiscible liquid 70 on top of the layer of aqueous salt solution 60. Underwater gas pressurization unit 110 further comprises a valve system 114 arranged to pressurize gas 90 by introducing pressurizing liquid 80 into vessel 111, evacuate pressurized gas 90A through top opening 112 upon reaching a specified pressure and introduce gas 90 into vessel 111 by evacuating pressurizing liquid 80 through bottom opening 113. Any of openings 112 and 113 may comprise a plurality of openings. In certain embodiments, separate openings may be used to introduce and evacuate gas 90 (as top opening 112) and liquid 80 (as bottom opening 113).

In certain embodiments, underwater gas pressurization unit 110 may further comprise a delivery unit 125 in fluid communication with valve system 114, arranged to receive pressurizing liquid 80 from underwater gas pressurization unit 110 and deliver pressurizing liquid 80 to underwater gas pressurization unit 110.

In certain embodiments, and with reference to the detailed example below, delivery unit 125 may comprise a gasifier 120, such as a boiler 120, arranged to gasify pressurizing liquid 80; a condenser 130 located at a specified underwater depth and arranged to condense gasified pressurizing liquid 80A; a heat insulated pipework 122 arranged to deliver gasified pressurizing liquid 80A from gasifier 120 to condenser 130; and a container 140 such as underwater storage 140, arranged to receive condensed pressurizing liquid 80 and deliver by gravity pressurizing liquid 80 to valve system 114 (e.g., to valves 114B).

In certain embodiments, underwater gas pressurization unit 110 may comprise two vertical vessels 111 which are arranged to operate reciprocally, one vessel pressurizing gas 90 while the other vessel receiving gas 90.

Underwater gas pressurization unit 110 may be associated with a natural gas production platform 20 and receive natural gas as gas 90 from platform 20. Liquefied natural gas 90 may be stored in underwater storage 92 or be delivered to the shore. Vessels 111 are arranged to withstand underwater pressure, with respect to the operation conditions of unit 110. Underwater gas pressurization unit 110 may further be arranged to compress and/or liquefy other gases or gas mixture. In certain embodiments, underwater gas pressurization unit 110 may be arranged to compress and/or liquefy coolants that are used to liquefy natural gas 90, as illustrated below. Multiple underwater gas pressurization units 110 may be arranged as a cascade to compress gas 90 step-wise, each stage of the cascade receiving compressed gas and further compressing the received gas. Multiple underwater gas pressurization units 110 may be arranged in a cascade to compress and liquefy several types of gases, having rising critical point temperatures, to enable cooling of the last gas in the cascade by sea water, e.g., by deep sea water. In such an arrangement, the cooling effect of sea water is gradually intensified to enable cryogenic cooling of the first gas in the cascade. A non-limiting detailed example is presented below.

Figure 3:
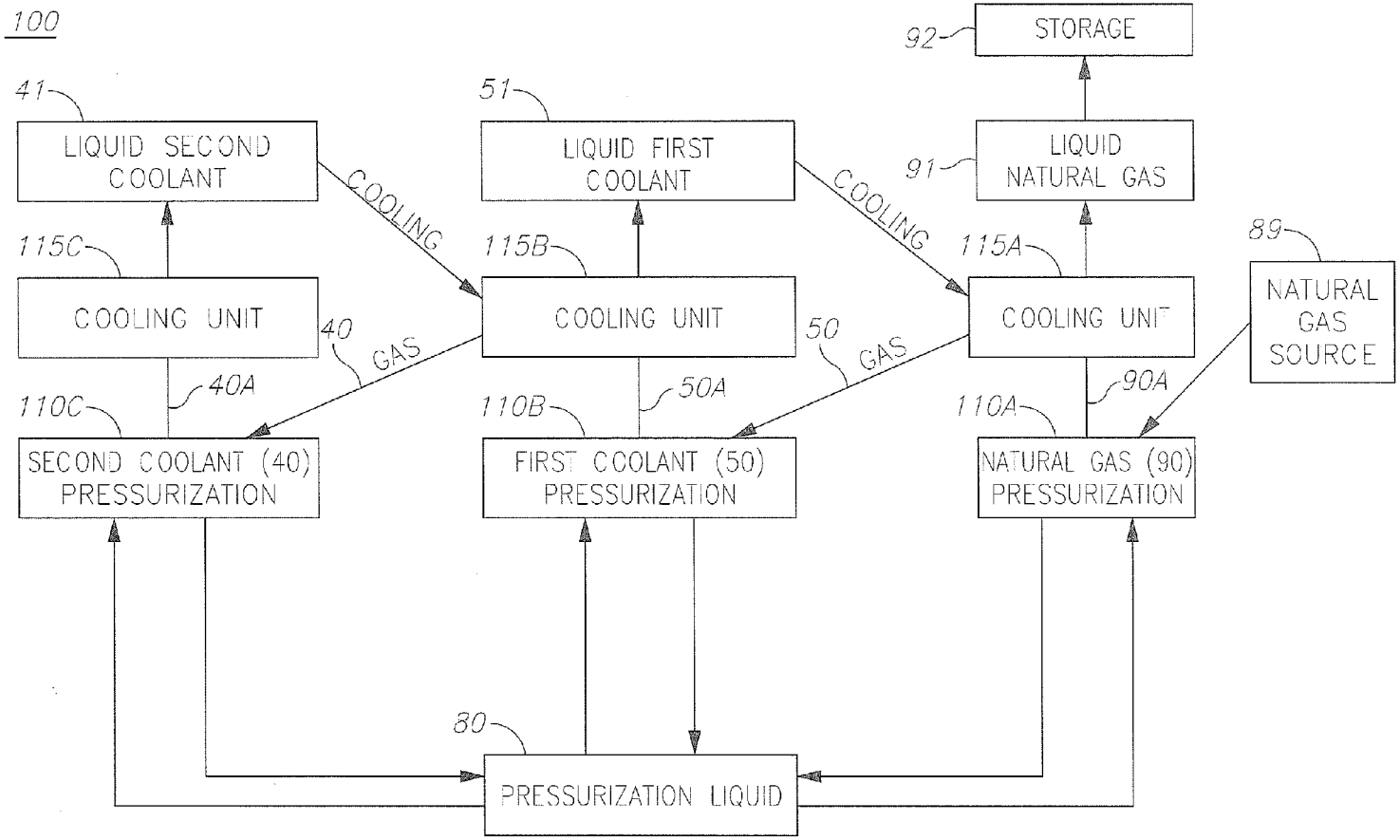
FIG. 3 is a high level schematic block diagram of an underwater natural gas liquefaction system, according to some embodiments of the invention.
Figure 4:
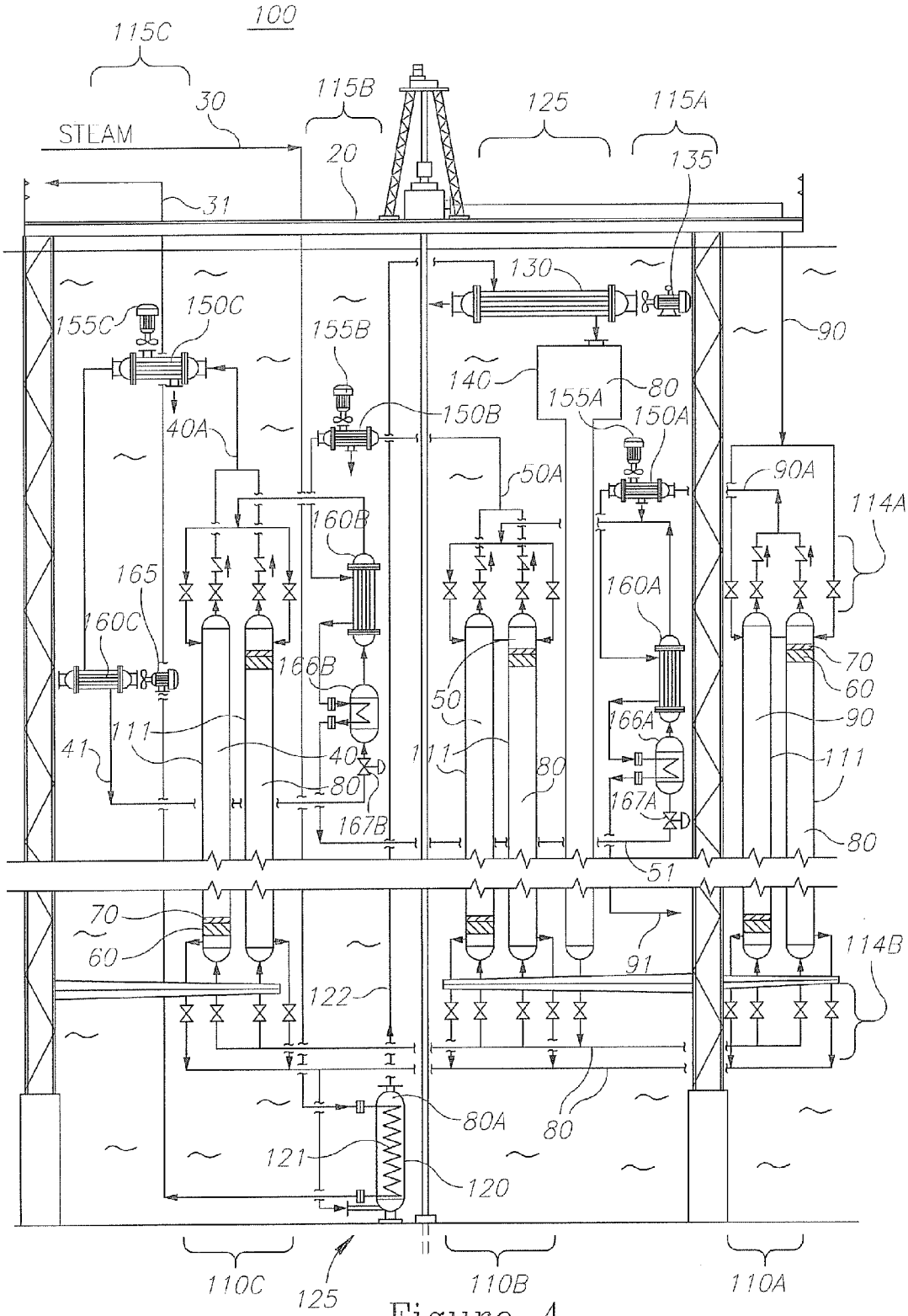
FIG. 4 is a high level schematic illustration of an underwater natural gas liquefaction system, according to some embodiments of the invention.

FIG. 3 is a high level schematic block diagram of an underwater natural gas liquefaction system 100, according to some embodiments of the invention; FIG. 4 is a high level schematic illustration of underwater natural gas liquefaction system 100, according to some embodiments of the invention.

In certain embodiments, underwater natural gas liquefaction system 100 may comprise three underwater gas pressurization units 110A, 110B, 110C arranged as a cooling and pressurizing cascade for efficiently liquefying natural gas.

A first unit 110A may be arranged to pressurize natural gas 90 and a natural gas cooling unit 115A may be arranged to liquefy pressurized natural gas 90A (to yield liquid natural gas 91) using a first coolant 50.

A second unit 110B may be arranged to pressurize first coolant 50 and a first cooling unit 115B may be arranged to liquefy pressurized first coolant 50A (to yield liquid first coolant 51) using a second coolant 40. Liquid first coolant 51 is used in natural gas cooling unit 115A to cool pressurized natural gas 90A.

A third unit 110C may be arranged to pressurize second coolant 40 and a second cooling unit 115C may be arranged to liquefy pressurized second coolant 40A (to yield liquid second coolant 41), possibly using ambient sea water. Liquid second coolant 41 is used in first cooling unit 115B to cool pressurized first coolant 50A.

In certain embodiments, system 100 may comprise additional stages using additional coolants, or several pressurization stages (each with corresponding vessels 111) for each coolant and so forth. The number and type of coolants and the number and specifications of pressurization units 110 may be determined according to sea conditions (depth, surface temperatures, construction limitations) and operational considerations.

First coolant 50 may be selected to have its critical point at a higher temperature than natural gas 90 and second coolant 40 is selected to have its critical point at a higher temperature than first coolant 50. In such configuration, the cooling power of sea water is amplified by using coolants with decreasing critical point temperature until enabling cooling compresses natural gas 90A.

Natural gas 90 produced from the sea bottom (as a natural gas source 89) for liquefaction by platform 20 may be prepared by its dewatering from water vapors and purification (if necessary) from harmful impurities, such as hydrogen sulfide and carbon dioxide. Then, natural gas 90 may be introduced by suction into one of underwater vertical vessels 111 by discharging the column of volatile heavy liquid 80 screened by a layer of water-salt medium 60 covered with liquid hydrocarbon 70, as explained above.

Natural gas 90 may be compressed in vessels 111 with a subsequent pressing-out of natural gas portion collected in the vertical underwater vessel 111 by feeding a volatile heavy liquid into such a cylinder 111 from a higher level under the layer of water-salt medium 60 remaining near its base.

Subsequently, system 100 may carry out cooling and condensation of compressed natural gas 90A, at the expense of evaporation of a low-boiling external coldness-transfer medium, e.g., first coolant 50. The natural gas, being under elevated pressure, is pressed-out for liquefaction from underwater vertical vessel 111 by a rising column of the volatile heavy liquid 80.

The liquefied natural gas may be accumulated in underwater storage 92 with its subsequent shipping and delivery to sea-shore consumers by pipeline transportation or by sea shipping in specialized tankers.

Pressurizing liquid 80 may be introduced into vessels 111 by gravity, utilizing height differences which are available in the sea. For this purpose, pressurizing liquid 80 goes through underwater regasification of volatile heavy liquid 80 discharged from vertical underwater vessels 111 (during gas suction into them) by an external heat-transfer medium such as gasifier 120, with a subsequent direction of the formed vapors 80A to condensation realized at a higher mark by their cooling with sea water (in condenser 130, cooled by propeller 135). After raising pressuring liquid 80 in gas form 80A, liquid 80 may be re-introduced into vessels 111 under gravitational action, as illustrated below.

Container 140 is used to accumulate volatile heavy liquid 80 in a collecting tank established at the upper level, with a subsequent feed of liquid non-aqueous medium 80 under the layer of water-salt solution 60 remaining in vertical vessels 111 after the suction of the subsequent portion of gas 90 into them.

Another underwater gas pressurization unit 110 may be used for suction of vapors of the external coldness-transfer medium 50 (after the evaporation of coolant 50 was used to take away the natural gas condensation heat) into one of vertical vessels 111 in the refrigerating cascade (see detailed example below), with its subsequent pressing out of cylinder 111 realized in a similar way, i.e., by feeding of volatile heavy liquid 80 under the layer of water-salt solution 60 remained in this vessel 111.

Subsequently, system 100 may carry out the cooling of vapors of tailing coldness-transfer medium 50 pressed out of vertical vessel 111, which cooled natural gas 90, and its condensation by the evaporation heat take-off from other, less low-boiling (in comparison with methane) coldness-transfer medium, which turns round, in its turn, in its own circulation loop preceding the refrigerating cascade stage. All heat-transfer mediums, the heating of which realize the transition of volatile heavy liquid from liquid to gaseous state in all stages of the cascade, may be cyclically moved through system 100.

EXAMPLE

In the following non-limiting example, pressurized natural gas 80A may be cooled by ethane as first coolant 50; Pressurized first coolant 50A may be cooled by propane as second coolant 40; Pressurizing liquid 80 may be difluorodibromomethane; Aqueous salt solution 60 may be calcium bromide aqueous solution; and water-immiscible liquid 70 may be liquid hydrocarbon.

Natural gas 90 may be fed from source 89 to liquefaction after drying-off water vapors and purification from hydrogen sulfide and sucked into one of vertical underwater vessels 111A and 111B operating e.g., in opposite phases.

Natural gas sucking-in occurs due to the discharge of difluorodibromomethane column (density 2.28 g/cm$^3$, boiling point 24.5° C.) filling such working cylinder.

Such low-boiling liquid obtained owing to alternate discharge of vertical vessels 111A and 111 is fed for regasification to boiler 120 heated by water vapor injected into its coil 121 from a steam turbine (not shown) installed on drilling platform 20, which is part of the steam power unit. Condensate formed as a result of condensation of this external heat-exchange medium is pressed out of coil 121 by the entering fresh vapor back to drilling platform 20, where this hot water is injected again into the steam-boiler (not shown) by a high-pressure pump (not shown).

To avoid mixing of natural gas sucked into vessels 111A and 111B with difluorodibromomethane vapors, a column of such volatile heavy liquid is screened by layer 60 of calcium bromide aqueous solution—a low-freezing water-salt liquid immiscible with organic environment, whose density is lower than that of difluorodibromomethane (depending on the concentration and temperature, the density of calcium bromide solutions can reach 1.82 g/cm$^3$). It is characterized by anomalously low freezing point depending on the ratio of the components of such antifreeze.

In turn, this layer 60 of water-salt medium screening the column of difluorodibromomethane is flooded by a layer of hexane 70 as a non-limiting example for the second coolant. Hexane may be used as second coolant 70 as it is the water-immiscible liquid hydrocarbon with the lowest density in this series of liquids (0.66 g/cm$^3$).

However, other water-immiscible low-freezing hydrocarbon liquids, such as, e.g., toluene (density 0.87 g/c$^3$ m), or their mixtures, whose vapors in natural gas cannot damage consumer properties of the latter, can be used as such uppermost liquid coverage.

Such a double liquid isolation of the gaseous phase in vertical vessels 111 from the volatile non-aqueous liquid prevents both the penetration of the vapors of difluorodibromomethane (which is not just incombustible, but one of the most efficient fire-fighting agents today) into the compressed natural gas, and methane moistening by water vapors that can exist above the surface of any solutions of mineral (organic) salts in water.

Organic vapors formed in boiler 120 at difluorodibromomethane transition from liquid to gaseous state go up through heat-insulated tract 122 to condenser 130 installed under drilling platform 120, in the upper layer of sea-water having (depending on the distance from the sea surface area) an average daily temperature in summer 12 to 14° C. (In case of natural gas production in low latitudes of the world ocean, if the temperature of the upper sea-water layer is close to 24° C., perfluoropentane can be used as the volatile heavy liquid instead of difluorodibromomethane. The former has a somewhat lower density 1.62 g/cm$^3$, but a higher condensation temperature equal to 29.3° C. Otherwise, condenser 130 should be submerged to a greater depth, where sea-water is colder in any season).

To improve the conditions of difluorodibromomethane condensation heat removal, condenser 130 is washed by sea water pumped through the latter by external marine propeller 135.

Difluorodibromomethane 80 converted in this way into the liquid state is accumulated in underwater storage 140, wherefrom it is fed to natural gas compression by a vertical stand pipe 122 to the base of underwater vertical vessel 111B adjacent to vessel 111A, said vessel 111B being completely filled by that time with methane in the process of emptying the working space of such vertical cylinder from the main volume of its previous liquid content.

For this purpose, liquid difluorodibromomethane is fed from underwater storage 140 under layer 60 of low-freezing water-salt medium remaining in vessel 111B, which screens the rising column of such volatile liquid.

In certain embodiments, system 100 comprises a delivery unit 125 which may comprise comprises a gasifier 120, such as boiler 120, arranged to gasify the pressurizing liquid; a condenser 130 located at a specified underwater depth and arranged to condense gasified pressurizing liquid 80A; a heat insulated pipework 122 arranged to deliver gasified pressurizing liquid 80A from gasifier 120 to condenser 130; and a container 140 such as underwater storage 140, arranged to receive condensed pressurizing liquid 80 and deliver by gravity pressurizing liquid 80 to valve system 114 (e.g., to valves 114B).

Due to the rise of difluorodibromomethane 80 level in cylinder 111, the volume that is not flooded with liquid medium above the surface of double liquid screen (layers 60 and 70) covering the column of non-aqueous liquid 80 starts gradually to diminish. It leads to the compression of methane 90 contained in vessel 111B. At the flooding of vertical vessel 111 with liquid medium 80 by 90%, the pressure of methane 90 remaining above the surface of hexane layer 70 increases tenfold. However, to raise the temperature of natural gas liquefaction from −161.5° C. (its liquefaction point at the atmospheric pressure) to the maximal possible, i.e. at the critical point (−82.5° C.), its pressure should be brought to at least 4.49 MPa.

Hence, after only about 2.2% of free geometric space of vertical vessel 111 must remain above the surface of water-salt medium 60 screened with liquid hydrocarbon 70. Natural gas 90 compressed to 4.5 MPa can be completely liquefied at its subsequent cooling down to the temperature on the order of −83° C. In certain embodiments, several vessels 111 may be used to build several compression stages, allowing a gradual compression of natural gas 90.

In certain embodiments, container 140 may be arranged to provide a specified head above vessels 111, to enable gravitation supply of pressurizing liquid 80 to vessels 111. For example, to achieve such extent of natural gas compression, the level of liquid difluorodibromomethane 80 in underwater storage 140 (communicating by vertical stand pipe 122 with any of vertical working vessels 111 where gases 90, 50, 40 are compressed), in order to equilibrate such pressure, should exceed the height mark of the surface of double liquid screen (60, 70) covering the column of volatile liquid, which supports the compressed gas 90A, by a head of minimum 201 meters, taking into account the fact that the density of such non-aqueous medium exceeds water density 2.28-fold.

Thus, when using difluorodibromomethane as a working medium 80 of such thermodynamic cycle, the bottom of underwater storage 140 of such heavy liquid 80 should be vertically apart of its upper level in vertical vessels 111 by a head of at least 201 meters (at the natural gas compression ratio equal to 45, i.e., from the atmospheric pressure of 0.1 MPa to its working value of 4.5 MPa).

In certain embodiments which utilize, as pressurizing liquid 80, perfluoropentane at sea gas fields in tropical latitudes (as a more easily condensable liquid) instead of difluorodibromomethane, this height drop should be 1.4 times greater, i.e., 283 meters, taking into account that perfluoropentane density equals 1.62 g/cm$^3$, and not 2.28 g/cm$^3$.

With growing sea depth, sea bottom closeness to drilling platform 20 does not limit the height drop between the columns of heavy liquid 80 used in such communicating vessels 111. Then, other volatile liquids 80 with even lower densities, such as hexafluorochlorobromopropane (density 1.55 g/cm$^3$) can be used as working media in the thermodynamic cycles. Their vapors 80A can be condensed in the uppermost (the most heated with solar radiation) sea water layers even on the hottest summer days (hexafluorochlorobromopropane condensation temperature is 35.7° C.). In his case, vertical vessels 111, in which natural gas 90 is compressed to such pressure, can be submerged to even greater depth until they reach sea bottom.

In other embodiments, in case of underwater gas production in the coastal zone, at small depths, even a heavier non-aqueous liquid 80, such as dibromofluoromethane (density 2.42 g/cm$^3$, boiling point 64.5° C.), can be used to fill a U-shape hydraulic system, in order to reduce the height of such water tower. In these embodiments, at least some of vessels 111 may be U-shaped, to reduce the required specified head for gravitational delivery of pressurizing liquid 80. In this case, the difference in the levels of liquid contents of such communicating vessels is even smaller, and a head of 194 meters may suffice. When using tribromofluoromethane (density 2.71 g/cm$^3$, boiling point 105° C.), this difference is a bit less than 170 meters, etc. Similarly, pressurizing liquid 80 may be selected to enable operation in given sea location and topography, and vessels 111 may be designed accordingly. Pressurizing liquid 80 and vessels 111 may be designed and selected to provide the required head of pressurizing liquid 80 with respect to at least one of vessels 111 at a given sea location.

At the operation of check valves 114A tuned to the pressure of 4.5 MPa, natural gas alternately compressed down to this pressure in vertical vessels 111 is brought out of them for cooling and condensation.

Pre-cooling of compressed natural gas 90A may be realized in heat exchanger 150A installed at the depth exceeding 100 meters. It can be attributed to the fact that the warm water store in the world ocean with the temperature of 10° C. and more makes up only about 8% of its total volume. It is concentrated in the upper sea water layer less than 100 m thick. Below this layer, with growing depth, water temperature gradually falls to 1 to 3° C. This is the temperature of about 75% of the entire volume of the world ocean. Such temperature regime in the deep part of seas and oceans remains practically unchanged all the year round and round the clock. Respectively, by pumping such free-of-charge coldness-transfer medium through heat exchanger 150A by marine propeller 155A, the temperature of compressed natural gas passing through it can be reduced to 3 to 5° C.

Gaseous medium pre-compressed down to 4.5 MPa and cooled in heat exchanger 150A down to 4° C. is fed, first, to recuperative heat exchanger 160A and then to coldness exchanger 166A refrigerated by evaporating a first coolant 51 such as liquid ethane as final cold-transfer medium 50. Coldness exchanger 166A may be located in the circulation loop of the stage of such refrigerating cascade, which precedes methane liquefaction. Note: in the present application, the term "coldness exchanger" is used to refer to a heat exchanger that operated to cool the respective fluid. The term "coldness-transfer medium" refers to any of the coolants in the system, e.g., first and second coolants 50, 40 as well as sea water at different temperatures.

Owing to the cryogenic temperature (−88.7° C.) achieved in coldness-exchanger 166A, at the transition of liquid ethane 51 (preliminarily throttled in regulating valve 167A) from liquid 51 to gaseous state 50, cold natural gas compressed in vertical vessels 111 to the pressure close to critical one, becomes liquid. After that, liquefied methane 91 is brought out, as a ready product, to underwater storage 92, wherefrom it is shipped afterwards to customers by gas-tankers or delivered to the beach in the liquid state by underwater pipelines.

Other cryogenic liquids, such as ethylene (normal boiling point −103.5° C.) or perfluoromethane (normal boiling point −127.9° C.) can be used as final coldness-transfer media that can liquefy, besides ethane, compressed natural gas. Here the pressure of methane compression should not necessarily reach 4.5 MPa, —in this case, natural gas can be liquefied at a lower pressure, too. Respectively, the head provided by container 140, i.e. the height difference between the levels of volatile heavy liquid 80 in the "water tower" (container 140) and in vertical vessels 111 communicating with it can be also reduced.

Gaseous ethane 50 leaving coldness-exchanger 166A, which has passed its coldness to pre-refrigerated methane 90A, may be fed to its liquefaction realized in this multi-stage system exactly in the same way.

For this purpose, ethane 50 leaving coldness-exchanger 166A after regasification is fed to recuperative heat exchanger 160A, where it passes its remaining artificial coldness to compressed methane. After that, such tailing coldness-transfer medium is compressed. For this purpose, first coolant 50 such as ethane is sucked into one of vertical vessels 111 of second gas pressurizing unit 110B working according to the same principals as first gas pressurizing unit 110A, with vessels 111 in opposite phases owing to liquid difluorodibromornethane from storage 140 alternately fed into them (more exactly, to their base) under the layer of water-salt medium.

First cooling unit 115A hence comprises heat exchanger 150A equipped with propeller 155A and recuperative heat exchanger 160A with coldness-exchanger 166A.

Difluorodibromomethane volumes discharged from vessels 111 after sucking-in recurrent portions of ethane are also fed for regasification into boiler 120. From there, organic vapors of such volatile liquid are stripped by the heat of the external heat-transfer medium (in the present case, the heat of water vapor condensed in coil 121) into condenser 130 installed at the upper level. This working liquid condensed as a result of heat exchange with sea water is accumulated again in storage 140, wherefrom it is fed for the next flooding of one of the vessels 111 of second unit 110B at ethane compression up to elevated pressure.

In contrast to methane (as gas 90), ethane (as first coolant 50) is much easier to liquefy (boiling point of this cryogenic liquid at atmospheric pressure is not −161.5° C., as for methane, but almost twice higher, more exactly, −88.6° C. The critical temperature of ethane liquefaction is positive and equals 32.3° C., which nearly always allows the use of sea water as a free-of-charge coldness-transfer medium for the removal of condensation heat of ethane compressed up to the critical pressure over the greatest part of the world ocean). In such embodiments, system 100 may operate with first coolant 50 to cool compressed gas 90A, the first coolant 50 may be liquefied by ambient low sea temperatures.

Other embodiments may be designed to operate even in the hottest summer days, in shallow areas of some natural reservoirs (e.g., the Caspian sea), in which sea-water temperature can increase up to a higher level.

In this case, even ethane 50 compressed to a critical pressure value (4.7 MPa) in vertical vessels 111 cannot be easily condensed with a high efficiency in a compact heat-exchange facility by a coldness-transfer medium of such a low refrigerating potential.

Hence, for a guaranteed maintenance of a high productivity of natural gas liquefaction process in any meteorological conditions of the operation of a sea gas field, ethane condensation may also be realized using artificial coldness produced in the first stage of such refrigerating cascade, where propane or ammonia can be used as a working medium.

For this purpose, ethane 50 may be compressed in vertical vessels 111 of second unit 110B to a more moderate pressure than the critical pressure (4.7 MPa). Ethane 50 may first be cooled by sea water in heat exchanger 150B equipped with propeller 155B, and then ethane 50 may be fed into recuperative heat exchanger 160B. Heat exchanger 160B may be arranged to remove the residues of artificial coldness carried out of coldness-exchanger 166B by a second coolant 41 such as propane, which is regasified in heat exchanger 166B. Second coolant 41 may be passed through preliminary throttling (after its liquefaction as described below) in regulating valve 167B.

Second cooling unit 115B hence comprises heat exchanger 150B equipped with propeller 155B and recuperative heat exchanger 160B with coldness-exchanger 166B.

Thus, the compressed first coolant 50 (e.g., ethane) is condensed in coldness exchanger 166B at the expense of the heat of the phase transition of the second coolant (e.g., propane) from liquid 41 into gaseous state 40.

Propane 40 circulating in the first stage of such refrigerating cascade is also the most easily liquefied gas of all coldness-transfer media used in such a system of methane liquefaction.

Propane condensation point at atmospheric pressure is not a cryogenic value. It exists in nature (−42.6° C.) and is quite comparable with meteorological conditions of atmospheric air above the area of the Arctic Ocean during winter polar nights. Critical temperature of its liquefaction equals −96.8° C. Its vapor pressure corresponding to such critical temperature is also considerably lower (4.1 MPa) than that of ethane (4.7 MPa). Therefore, it is not always reasonable to compress propane down to the pressures characteristic of ethane compression in vertical vessels 111 of second unit 110B.

Accordingly, propane liquefaction in the first stage of such refrigerating cascade may be realized in a similar way to that of ethane and methane, but under milder technological conditions. While gas 90 (e.g., methane) is compressed in vessels 111 of first unit 110A, and first coolant 50 (e.g., ethane) is compressed in vessels 111 of second unit 110B—second coolant 40 (e.g., propane) may be compressed in vessels 111 of third unit 110C.

For this purpose, two vertical vessels 111 of a third gas compressing unit 110C operating in opposite phases are used. Gaseous second coolant 40 (e.g., propane) is alternately sucked into them after regasification (in coldness-exchanger 166B) and recuperative heat exchange (in heat-exchanger 160B) is compressed in such vertical cylinders up to a pressure that is the higher, the warmer sea water, which is used for cooling this gas in heat exchanger 150C equipped with propeller 155C.

Propane 40, which is alternately compressed in vertical vessels 111, passes preliminary cooling with sea water in heat exchanger 150C and then is fed to liquefaction realized in an even more deep-water condenser 160C washed with even colder sea water pumped through it by propeller 165.

In this connection, it may be necessary to use colder sea-water when condenser 160C is fixed at a much lower geodesic mark than heat exchanger 150C, which ensures high propane condensation efficiency in any season and around the clock. In other embodiments, cooling unit 115C may be constructed similarly to cooling unit 115B. In certain embodiments (e.g., if first coolant 50 may be sufficiently cooled at deep sea temperatures), cooling unit 115B may be constructed as the illustrated cooling unit 115C.

Propane 41 liquefied in this way in condenser 160C (at the expense of free-of-charge refrigerating potential of deep sea water) is throttled in regulating valve 167B and fed after that to coldness-exchanger 166B.

Boiling at atmospheric pressure in coldness-exchanger 166B, propane (normal boiling point of liquid propane being −42.6° C.), passing from liquid to gaseous state, takes off condensation heat from ethane. This leads to liquefaction of such coldness-transfer medium pre-compressed beforehand in vertical vessels 111 of second unit HOB, which is contained in the circulation loop of the second stage of underwater refrigerating cascade.

Final recuperation of artificial coldness removed from coldness-exchanger 166 by propane vapors is realized in recuperative heat-exchanger 160 at the expense of coldness exchange between gaseous propane and compressed ethane fed for condensation.

Third cooling unit 115C hence comprises heat exchanger 150C equipped with propeller 155C and deep-water condenser 160C with propeller 165.

Propane 41 regasified in this way in coldness-exchanger 166B is returned for compression into one of vertical vessels 111 of third unit 1100, i.e. to the head of technological process, thus, closing the circulation loop of coldness-transfer medium, which is the working medium of the first stage of underwater refrigerating cascade.

Thus, at high production standards and trouble-free operation of the equipment, all cooling agents (e.g., first and second coolants 50, 40) used in such multi-stage technological cascade are practically not consumed, since the cycles of their circulation with respect to these substances are practically entirely closed.

Advantageously, the use of the invention may make it possible to overcome well-known deficiencies of traditional multi-stage methods of cascade liquefaction of natural gas not only due to the necessity of arranging refrigerating equipment on the working floor of a drilling platform of extremely limited production area, but also due to the degeneration of a rigid connection between the level of its thermodynamic perfection and the unit production capacity of methane-liquefying facility in the technological process of the invention.

Moreover, with growing productivity and, hence, increasing height of vertical underwater vessels 111 of units 110A, 110B and 110C (at the development of deep-water and extra-deep-water sea gas fields), the cyclicity of the process of compression of corresponding gases even decreases, and additionally compressing all working media of each stage of the refrigerating cascade uses thermal energy instead of electric power. Its generation is incomparably cheaper for sea gas fields than electricity generation by expensive ship power plants and the use of electric drive.

An additional advantage of arranging huge working cylinders of such hydraulic compressor in underwater conditions is an increase in the efficiency of the removal of gas compression heat with an increase in their vertical overall dimensions. The point is that most of sea gas fields discovered by today are located at deep and super-deep parts of the world ocean, which allows the erection of such vertical vessels 111 hundreds and thousands meters high. Thus, the most part of the surface of natural heat exchange of such compression equipment with the environment turns out to be submerged into sea water having the year-round temperature 1 to 3° C., which allows an essential decrease in the total energy consumption by the system of artificial coldness generation at the expense of a removal of a significant part of heat taken from natural gas by such free-of-charge coldness-transfer medium.

Advantageously, operating below sea level also reduces the ambient operation temperature. Thus, natural gas liquefaction is more effective and particularly more thermally efficient than liquefaction above the sea surface or on the shore.

Furthermore, the invention is of particular interest for developing deep and extra-deep sea gas fields. It is due not only to the fact that with sea depth growth, sea-water temperature decreases, and it becomes possible to install higher vertical underwater vessels 111, but also to the hydrostatic pressure growth. Thus, the internal pressure of compressed gas contained in any underwater vessels is countered by the external hydrostatic pressure. This decreases the material capacity of the principal technological equipment, which makes it cheaper and ensures, at the same time, a higher safety of its operation.

Even greater prospects of a decrease in power consumption for the liquefaction of methane produced on the sea bottom arise in case of the development of deep sea-water gas fields located in zones of elevated heat-release activity of the Earth's interior. In such cases, besides drilling gas wells, wells reaching rocks with elevated temperature may be drilled under the sea bottom from drilling platform 20. When the circulation of heat-transfer medium (which can regasify, passing through coil 121 of boiler 120, such volatile liquid as difluorodibromomethane) in this loop is organized, the consumption of commercial power resources by such technological process becomes even smaller.

Taking into account that methane itself is the main energy carrier at sea gas fields, the use of free-of-charge heat of the Earth's interior for closing compression cycles for all kinds of gaseous media in the method of the invention of natural gas compression ensures an additional increment of the production capacity of such drilling platform with respect to its final product.

In certain embodiments, the use of the present invention allows the development of sea gas fields located at a distance of hundreds and thousands kilometers from ocean shores irrespective of natural gas occurrence depth. After all, transportation of one kg of gaseous methane to far and to extra-far distances is incomparably more expensive than that of one kg of liquid natural gas, since the density of one cubic meter of gaseous methane is only 720 g/m$^3$, while one cubic meter of liquid methane weighs about 450 kg, i.e., 625 times more. Besides, liquefied methane, in contrast to natural gas, is practically incompressible. Respectively, at its pumping by trunk pipelines, the main power consumption for its delivery to long distances is connected with overcoming friction forces between such extremely low-viscous liquid and the internal surface of the throughway. Meanwhile, at gaseous methane pumping, the main power consumption is connected with its compression, and not transportation.

Figure 5:
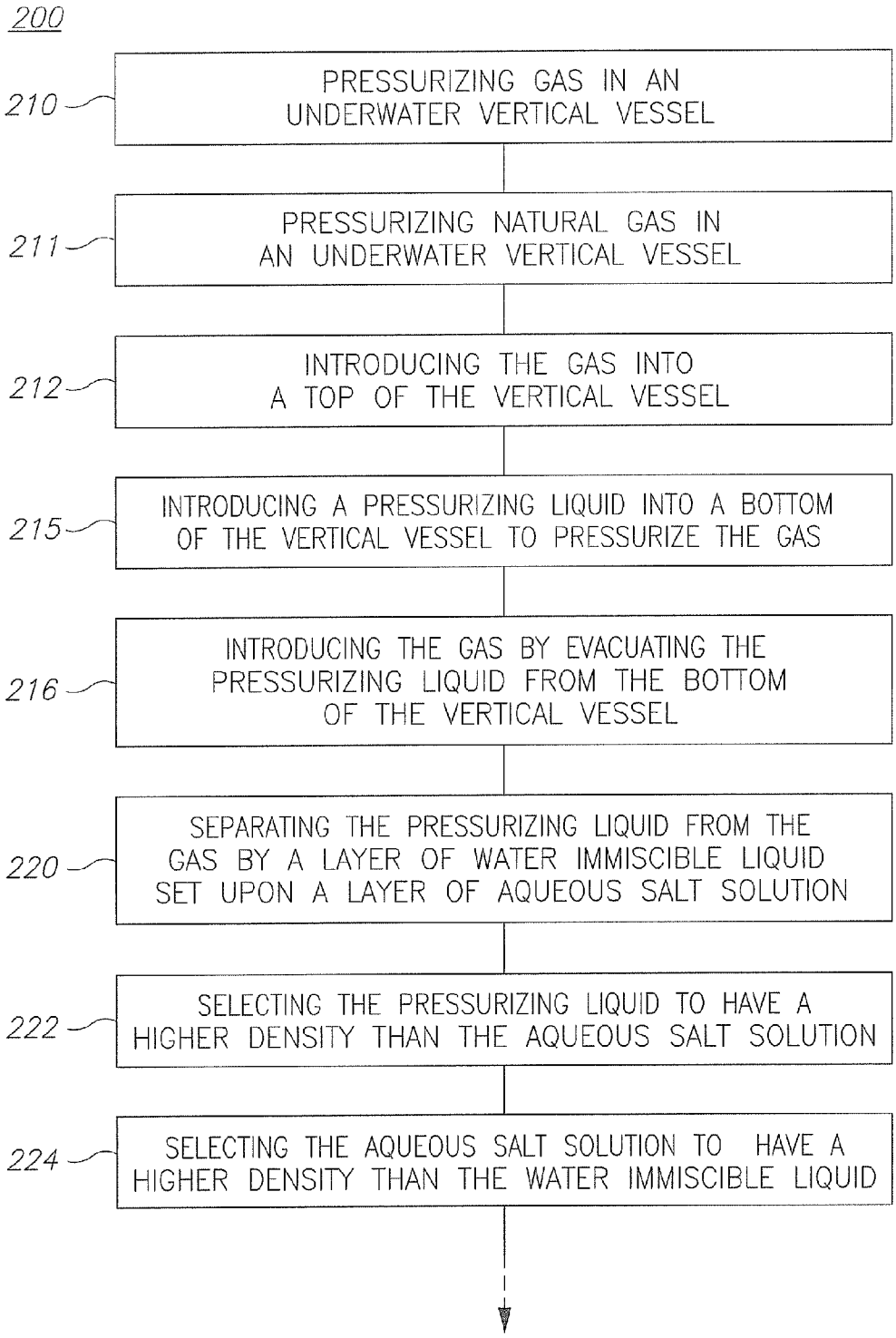
FIG. 5 is a high level schematic flowchart illustrating a gas compression and liquefaction method, according to some embodiments of the invention.

FIG. 5 is a high level schematic flowchart illustrating a gas compression and liquefaction method 200, according to some embodiments of the invention. Method 200 may comprise pressurizing gas, such as natural gas or other gases such as ethane or methane. Method 200 may further comprise cooling the compressed gas to liquefy it. For example, pressurizing the gas may surpass the pressure of its critical point and cooling the compressed gas may thus liquefy the gas. In certain embodiments, method 200 may compress and liquefy natural gas, as illustrated in a non-limiting example below.

Method 200 comprises pressurizing the gas in at least one vertical vessel (stage 210), e.g., pressurizing natural gas (stage 211), by cyclically (stage 235): (i) introducing the gas into a top of the at least one vertical vessel (stage 212); (ii) introducing a pressurizing liquid into a bottom of the at least one vertical vessel to pressurize the gas (stage 215); separating the pressurizing liquid from the gas by a layer of water immiscible liquid which is net upon a layer of aqueous salt solution (stage 220); and evacuating the pressurized gas through the top opening upon reaching a specified pressure (stage 230). The pressurization may be carried out cyclically (stage 235), e.g., by introducing the gas by evacuating the pressurizing liquid from the bottom of the at least one vertical vessel (stage 216). Thus natural gas may be continuously pressurized by introducing and evacuating the pressurizing liquid.

In certain embodiments, method 200 may further comprise selecting the pressurizing liquid to have a higher density than the aqueous salt solution (stage 222); selecting the aqueous salt solution to have a higher density than the water immiscible liquid (stage 224); and selecting the water immiscible liquid to have a higher density than the gas (stage 226), to maintain the gas on top of the layer of water-immiscible liquid, the layer of water-immiscible liquid on top of the layer of aqueous salt solution and the layer of aqueous salt solution on top of the pressurizing liquid (stage 228).

In certain embodiments, method 200 may further comprise delivering evacuated pressurizing liquid by gasification, upwards delivery, condensation and downwards delivery, comprising the following stages: delivering evacuated pressurizing liquid back to the bottom of the vessel (stage 240); gasifying the evacuated pressurizing liquid (stage 242); delivering the gasified pressurizing liquid upwards in an insulated pipe (stage 244); condensing the gasified pressurizing liquid (stage 246); delivering the condensed pressurizing liquid downwards (stage 248) and selecting the pressurizing liquid and designing the vessels to provide a specified head of the pressurizing liquid with respect to the at least one vessel at a given sea location (stage 249).

In certain embodiments, method 200 may further comprise liquefying the pressurized natural gas by cooling with a first coolant (stage 250) and selecting the first coolant to have its critical point at a higher temperature than the natural gas (stage 255). Cooling by the first coolant (stage 250) may comprise gasifying the first coolant to cool the pressurized natural gas (stage 252).

In certain embodiments, method 200 may further comprise pressurizing the first coolant (stage 257) and liquefying the pressurized first coolant by cooling with a second coolant (stage 260). Method 200 may further comprise selecting the second coolant to have its critical point at a higher temperature than the first coolant (stage 265). Cooling by the second coolant (stage 260) may comprise gasifying the second coolant to cool the pressurized natural gas (stage 262).

In certain embodiments, method 200 may further comprise pressurizing the second coolant (stage 267) and liquefying the pressurized second coolant by cooling with sea water (stage 270).

Advantageously, compression by pressurizing liquid 80 is superior to compression in current pistons or other mechanical compression unit in the following aspects. First, the compression heat is dissipated into the liquids and the sea, and does not damage moving parts (e.g., bearings, insulation rings etc.). Second, gas introduction by evacuation of pressurizing liquid 80 is more efficient than using the return stroke of a piston system, especially at high operation speeds. Also, the compression by liquid is more scalable than piston system, which must face the difficulty of increasing inertia of the piston head. Finally, due to the reduction of the number of mechanical parts, underwater operation and flame retarding nature of at least some of the usable pressurizing liquids 80, the disclosed systems and methods are significantly safer than current systems.

Advantageously it is an object of the present invention to weaken the fall of energy perfection level of the process with its productivity increase, to simplify the instrumental interpretation, to reduce electrical energy consumption by the system for natural gas liquefaction, as well as to increase the safety degree of marine gas fields.

In the above description, an embodiment is an example or implementation of the invention. The various appearances of "one embodiment", "an embodiment", "a certain embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Certain embodiments of the invention may include features from different embodiments disclosed above, and certain embodiments may incorporate elements from other embodiments disclosed above. The disclosure of elements of the invention in the context of a specific embodiment is not to be taken as limiting their used in the specific embodiment alone.

Furthermore, it is to be understood that the invention can be carried out or practiced in various ways and that the invention can be implemented in certain embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

The invention claimed is:

1. An underwater gas pressurization unit comprising:

at least one vertical vessel arranged to receive gas through a top of the vessel and a pressurizing liquid through a bottom of the vessel, and further comprising a layer of water- immiscible liquid upon a layer of aqueous salt solution, wherein a density of the pressurizing liquid is higher than a density of aqueous salt solution, which is in turn higher than a density of the water-immiscible liquid, to maintain the layer of aqueous salt solution on top of the pressurizing liquid and to maintain the layer of water-immiscible liquid on top of the layer of aqueous salt solution, and a valve system arranged to pressurize the gas by introducing the pressurizing liquid into the vessel, evacuate the pressurized gas through the top of the vertical vessel upon reaching a specified pressure and introduce gas into the vessel by evacuating the pressurizing liquid through the bottom of the vertical vessel, wherein the gas is continuously pressurized by the introducing and the evacuating of the pressurizing liquid, and wherein the pressurizing liquid comprises at least one completely or partially halogenated hydrocarbon of the alkane homologous series, the underwater gas pressurization unit further comprising at least two underwater gas pressurization units, a first unit arranged to pressurize natural gas, wherein the system further comprises a natural gas cooling unit arranged to liquefy the pressurized natural gas using a first coolant; and a second unit arranged to pressurize the first coolant, wherein the system further comprises a first cooling unit arranged to liquefy the pressurized first coolant.

2. The underwater gas pressurization unit of claim 1, further comprising a delivery unit in fluid communication with the valve system, arranged to receive the pressurizing liquid therefrom and deliver the pressurizing liquid thereto.

3. The underwater gas pressurization unit of claim 2, wherein the delivery unit comprises:

a gasifier arranged to gasify the pressurizing liquid;

a condenser located at a specified underwater depth and arranged to condense the gasified pressurizing liquid;

a heat insulated pipework arranged to deliver the gasified pressurizing liquid from the gasifier to the condenser; and a container arranged to receive the condensed pressurizing liquid and deliver by gravity the pressurizing liquid to the valve system.

4. The underwater gas pressurization unit of claim 3, wherein the container is arranged to provide a specified head above the at least one vessel, the specified head configured to enable the gravitational delivery.

5. The underwater gas pressurization unit of claim 4, wherein the pressurizing liquid is selected and the at least one vessel is designed to provide the specified head at a given location.

6. The underwater gas pressurization unit of claim 1, comprising two vertical vessels which are arranged to operate reciprocally, one vessel pressurizing gas while the other vessel receiving gas.

7. The underwater gas pressurization unit of claim 1, wherein the gas is natural gas.

8. The underwater gas pressurization unit of claim 7, associated with a natural gas production platform and receiving the natural gas therefrom.

9. The underwater gas pressurization unit of claim 1, wherein the at least one vessel is arranged to withstand underwater pressure.

10. The underwater natural gas liquefaction system of claim 1, wherein the pressurizing liquid is difluorodibromomethane.

11. the underwater natural gas liquefaction system of claim 1, wherein the aqueous salt solution is a calcium bromide aqueous solution and the water-immiscible liquid is a liquid hydrocarbon.

12. The underwater natural gas liquefaction system of claim 1, wherein the first cooling unit is arranged to liquefy the pressurized first coolant using a second coolant, the system further comprising a third underwater gas pressurization unit arranged to pressurize the second coolant and a second cooling unit arranged to liquefy the pressurized second coolant, and wherein the second coolant is selected to have its critical point at a higher temperature than the first coolant.

13. The underwater natural gas liquefaction system of claim 12, wherein the first coolant is ethane and the second coolant is propane.

* * * * *